US008493311B2

(12) United States Patent
Matsuura

(10) Patent No.: US 8,493,311 B2
(45) Date of Patent: Jul. 23, 2013

(54) DISPLAY DEVICE

(75) Inventor: Yoshiyuki Matsuura, Anpachi-cho (JP)

(73) Assignee: Japan Display West Inc., Chita-Gun, Aichi-Ken (JP)

( * ) Notice: Subject to any disclaimer, the term of this patent is extended or adjusted under 35 U.S.C. 154(b) by 587 days.

(21) Appl. No.: 12/363,205

(22) Filed: Jan. 30, 2009

(65) Prior Publication Data

US 2009/0237329 A1 Sep. 24, 2009

(30) Foreign Application Priority Data

Mar. 24, 2008 (JP) ..... 2008-075300

(51) Int. Cl.
*G09G 3/36* (2006.01)

(52) U.S. Cl.
USPC ..... 345/100; 345/96; 345/204

(58) Field of Classification Search
None
See application file for complete search history.

(56) References Cited

U.S. PATENT DOCUMENTS 5,682,175 A * 10/1997 Kitamura ..... 345/98
6,756,960 B2 6/2004 Miyatake
2004/0160432 A1* 8/2004 Kubota et al. ..... 345/204
2004/0196248 A1* 10/2004 Sekine ..... 345/100
2005/0030303 A1* 2/2005 Morita et al. ..... 345/204

FOREIGN PATENT DOCUMENTS

JP 2000-267616 9/2000
JP 2002-251176 9/2002
JP A-2002-251176 9/2002
JP A-2003-122322 4/2003

OTHER PUBLICATIONS

Japanese Office Action dated Mar. 8, 2011 for corresponding Japanese Appl. No. 2008-075300.

* cited by examiner

*Primary Examiner* — Joseph Haley
(74) *Attorney, Agent, or Firm* — K&L Gates LLP

(57) ABSTRACT

A display device includes a plurality of shift register sections, each being configured to sequentially generate a sampling pulse for writing a video signal into a pixel, wherein each of the plurality of shift register sections includes an even number of shift registers, and wherein one sampling pulse is generated by each of the plurality of shift register sections, and substantially all of the sampling pulses are generated on the basis of either the rising edges of a clock signal or the falling edges of a clock signal, whichever is selected in advance.

8 Claims, 12 Drawing Sheets

(COMPARATIVE EXAMPLE)

(COMPARATIVE EXAMPLE)

(COMPARATIVE EXAMPLE)

DISPLAY DEVICE

BACKGROUND

1. Technical Field

The present invention relates to display devices and, more particularly, to a display device including a plurality of shift registers.

2. Related Art

To date, display devices including a plurality of shift registers have been well known to those skilled in the art (refer to, for example, JP-A-2003-122322).

In JP-A-2003-122322 described above, a liquid crystal display apparatus including switch sections (HSW) located between data lines and image signal lines, and further, shift registers configured to generate control signals (i.e., sampling pulses) for performing control of turning on/off of the switch sections has been disclosed. The liquid crystal display device disclosed in JP-A-2003-122322 described above is configured to generate the sampling pulses on the basis of the rising edges and falling edges of a clock signal and sequentially output the sampling pulses to the switch sections.

However, the liquid crystal display device disclosed in JP-A-2003-122322 described above is configured to, for example, generate the sampling pulse on the basis of the rising edge of the clock signal at a first stage of the shift registers, and on the basis of the falling edge of the clock signal at a second stage of the shift registers. Therefore, a difference between a rising time of the clock signal (i.e., a period of time necessary for the rising edge of the clock signal to complete rising from an L-level to an H-level: tr) and a falling time of the clock signal (i.e., a period of time necessary for the falling edge of the clock signal to complete falling from an H-level to an L-level: tf) due to variations of the characteristics of driving sections and circuit elements causes a difference between the pulse width of the sampling pulse generated on the basis of the rising edge of the clock signal and that generated on the basis of the falling edge of the clock signal. Therefore, the pulse width of each of the two kinds of sampling pulses becomes unequal, and thus, the inequality causes a difference between durations while respective groups of the switch sections, corresponding to the two kinds of the sampling pulses, are under the turned-on condition, and further, the difference leads to a disadvantage in which the writing time of video signals is different for each group of pixels which corresponds to one of the two groups of the switch sections.

Furthermore, when, upon receipt of a sampling pulse, the switch sections connected to the data lines turn on, the level of a COM voltage is likely to vary due to parasitic capacitance being generated between the data lines and the wiring that is at the COM voltage. In this case, under a normal condition, the level of the COM voltage, which varies upon turning on of the switch sections, subsequently returns to the original level while the switch sections are being turned on. On the contrary, in the case where the pulse widths of two respective kinds of the supplied sampling pulses are unequal, the inequality causes a difference between durations while two respective groups of the switch sections (HSW) are under the turned-on condition, and further, the difference leads to a disadvantage in which the ratio of the returned level of the COM voltage to the original level of the COM voltage is different for each group of pixels which corresponds to one of the two groups of the switch sections.

Thus, the disadvantages described above cause a difference in the brightness of each group of pixels, which leads to diminishing of the quality of image display.

SUMMARY

Accordingly, it is desirable to provide a display device capable of preventing the quality of image display from being diminished.

A display device according to a first aspect of the invention includes a plurality of shift register sections, each being configured to sequentially generate a sampling pulse for writing a video signal into a pixel, wherein each of the plurality of shift register sections includes an even number of shift registers, and wherein one sampling pulse is generated by each of the plurality of shift register sections, and substantially all of the sampling pulses are generated on the basis of either the rising edges of a clock signal or the falling edges of a clock signal, whichever is selected in advance.

In the display device according to the first aspect of the invention, as described above, by providing a configuration in which all of the sampling pulses are generated on the basis of either the rising edges or the falling edges of the clock signal, even in the case where the rising time (tr) and the falling time (tf) of the clock signal are different each other, since substantially all of the sampling pulses are generated on the basis of only either the rising edges or the falling edges of the clock signal, it is possible to generate the sampling pulses, each having substantially the same pulse width. Further, in this case, even if the level of the COM voltage varies due to the parasitic capacitance occurring between the data lines and the wiring of the COM voltage, the ratio of the returned level of the COM voltage to the original level of the COM voltage in each of the pixels becomes equal because each of the sampling pulses has substantially the same pulse width. Accordingly, it is possible to prevent occurrence of a difference in brightness of each of the pixels, and thus, it results in preventing the quality of image display from being diminished.

In the display device according to the first aspect of the invention, preferably, each of the plurality of shift register sections includes two shift registers, and one sampling pulse is generated on the basis of the two shift registers. By providing such a configuration as described above, in the case where, in each of the shift register sections, an output of a first stage of the shift registers is inputted to a second stage of the shift registers and the sampling pulse is generated from the second stage of the shift registers, it is possible to generate the sampling pulses on the basis of only either the rising edges or the falling edges of the clock signal in all of the shift register sections. For example, in an existing method in which, in the case where one sampling pulse is generated from one shift register, a first group of sampling pulses are generated on the basis of the rising edges of the clock signal by odd-numbered stages of the shift registers, whereas a second group of sampling pulses are generated on the basis of the falling edges of the clock signal by even-numbered stages of the shift registers, and it results in a difference between the clock width of the first group of sampling pulses and that of the second group of sampling pulses due to the difference between the rising time (tr) and the falling time (tf) of the clock signal; however, in the display device according to the first aspect of the invention, it is possible to surely generate the sampling pulses each having substantially the same pulse width.

In the display device according to the first aspect of the invention, preferably, a plurality of pixels constitute each of pixel blocks, and each of the pixel blocks is supplied with one sampling pulse, and the video signals are simultaneously written into the plurality of pixels in each of the pixel blocks on the basis of one sampling pulse generated by one of the shift register sections which includes the even number of shift registers. By providing such a configuration as described above, it is possible to simultaneously write the video signals into each of the pixel blocks which is composed of a plurality of pixels. Further, in this case, the sampling pulses, each being supplied to one of the pixel blocks, are generated on the basis of either the rising edges or the falling edges of the clock signal, and thus, have substantially the same pulse width, so that it is possible to prevent a difference in brightness of each of the pixel blocks.

In this case, preferably, the display device according to the first aspect of the invention further includes video signal lines each supplying the video signal, data lines each supplying the pixel with the video signal supplied from one of the video signal lines, and switch sections each being provided for one of the data lines and being located between one of the video signal lines and one of the data lines, wherein one sampling pulse supplied to each of the pixel blocks is allowed to perform control of each of the switch sections which corresponds to one of the pixels in each of the pixel blocks, and wherein, when a certain one of the pixel blocks is supplied with the video signals, the switch sections, each corresponding to one of the pixels in the certain one of the pixel blocks, are simultaneously turned on, so that respective video signals are supplied to the pixels in the certain one of the pixel blocks. By providing such a configuration as described above, one of the sampling pulses each having substantially the same pulse width is sequentially supplied to the switch sections in each of the pixel blocks, so that each of the switch sections in each of the pixel blocks is controlled so as to turn on during substantially the same period of time, and thus, it is possible to surely write the video signal into each of the pixels in each of the pixel blocks during substantially the same period of time.

In the display device according to the first aspect of the invention, preferably, each of the plurality of shift register sections includes two shift registers, and the clock signal is supplied to a first shift register and a second shift register of the two shift registers, and the sampling pulse is outputted from the second shift register. By providing such a configuration as described above, firstly, in the case where a signal is inputted to the first shift register on the basis of the rising edge of a pulse of the clock signal, the sampling pulse is not outputted on the basis of the falling edge of a next pulse of the clock signal but is outputted from the second shift register on the basis of the rising edge of the next pulse of the clock signal, and therefore, it is possible to generate the sampling pulse on the basis of only the rising edge of the clock signal. Secondly, even in the case where a signal is inputted to the first shift register on the basis of the falling edge of the clock signal, in the same manner as or in a manner similar to that described above, it is possible to generate the sampling pulse on the basis of only the falling edge of the clock signal.

In this case, preferably, in each of the shift register sections, a signal outputted from the first shift register of the two shift registers is inputted to the second shift register of the two shift registers, and an output signal is generated as the sampling pulse by the second shift register. By providing such a configuration as described above, in the case where a signal is inputted to the first shift register on the basis of the rising edge of a pulse of the clock signal, on the basis of the falling edge of a next pulse of the clock signal, the sampling pulse is not outputted from the first shift register but is supplied to the second shift register, and further, the sampling pulse is outputted from the second shift register on the basis of the rising edge of the next pulse of the clock signal. Accordingly, it is possible to surely generate the sampling pulse on the basis of only the rising edge of the clock signal. Further, even in the case where a signal is inputted to the first shift register on the basis of the falling edge of the clock signal, in the same manner as or in a manner similar to that described above, it is possible to generate the sampling pulse on the basis of only the falling edge of the clock signal.

In the display device according to the first aspect of the invention, preferably, a plurality of pixels constitute each of pixel blocks, and each of the pixel blocks is supplied with one sampling pulse, and by varying the pulse width of a start pulse supplied when driving the shift registers, the writing of the video signals can be performed by either a method in which, subsequent to completion of the writing of the video signals into a certain one of the pixel blocks, the writing of the video signals into a next one of the pixel blocks is performed, or a method in which, under the condition where the writing of the video signals into the certain one of the pixel blocks is being performed, the writing of the video signals into the next one of the pixel blocks is performed. By providing such a configuration as described above, without changing the circuit configuration, and merely by varying the pulse width of the start signal, it is possible to perform writing of video signals into the pixels by using one of the two writing methods described above. In addition, in the existing display device in which one sampling pulse is generated by one shift register, for example, in the configuration of the writing method in which, subsequent to completion of the writing of the video signals into a certain one of the pixel blocks, the writing of the video signals into a next one of the pixel blocks is performed, in the case where the pulse width of the start pulse is made wider, one sampling pulse is continuously generated twice by each shift register. For this reason, the mere changing of the pulse width of the start pulse does not lead to selection of either of the described-above two writing methods for writing the video signals into the pixels. On the contrary, in the display device according to the first aspect of the invention, by providing a configuration in which one sampling pulse is generated by the two shift registers, even in the case where the pulse width of the start signal is made wider, the outputted sampling pulse is not under the turned-off condition on the rising edge or the falling edge of a pulse of the clock signal, but is under the turned-off condition on the rising edge or the falling edge of a next pulse of the clock signal. That is, even in the case where the pulse width of the start signal is made wider, once the start signal is supplied, the sampling pulse is outputted only once on the basis of either the rising edge or the falling edge of the clock signal. Additionally, this advantage will be hereinafter described in detail in exemplary embodiments.

In this case, preferably, each of the plurality of shift register sections includes two shift registers, wherein the clock signal is supplied to a first shift register and a second shift register of the two shift registers, and the sampling pulse is outputted from the second shift register, and wherein an output signal generated by the second shift register in the shift register section is outputted as the sampling pulse to the corresponding switch sections, and is inputted to a first shift register in a next stage of the shift register sections. By providing such a configuration as described above, for example, since the outputting of the sampling pulse from the second shift register and the outputting of the signal to a next stage of the shift register sections from the second shift register are performed at the same time in synchronization with the rising edge of the clock signal, it is possible to perform outputting the sampling pulse and rising the output signal from the next stage of the shift register sections on the basis of the rising edges of the clock signal. Further, in the same manner as or in a manner similar to that described above, it is possible to perform outputting the sampling pulse and rising the output signal from the next stage of the shift register sections in synchronization with the falling edges of the clock signal.

An electronic device according to a second aspect of the invention includes the display device according to the first aspect of the invention. By providing such a configuration, it is possible to prevent occurrence of a difference in brightness, and further, it leads to realization of an electronic device capable of displaying images having high quality of display.

DESCRIPTION OF EXEMPLARY EMBODIMENTS

Exemplary embodiments of the invention will be hereinafter described with reference to the accompanying drawings.

First Embodiment

Figure 1:
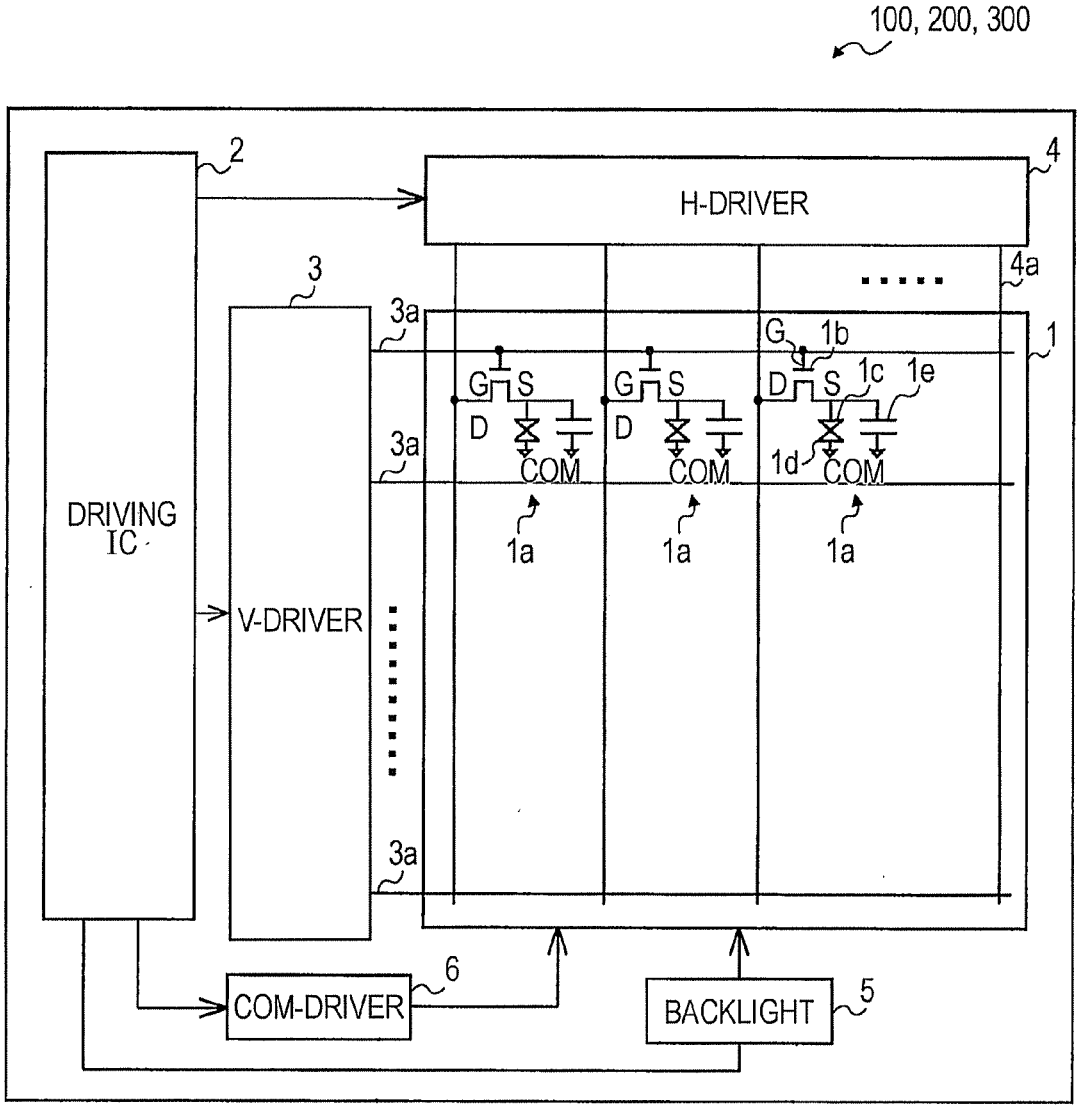
FIG. 1 is a block diagram depicting an overall configuration of a liquid crystal display device according to a first embodiment of the invention.
Figure 2:
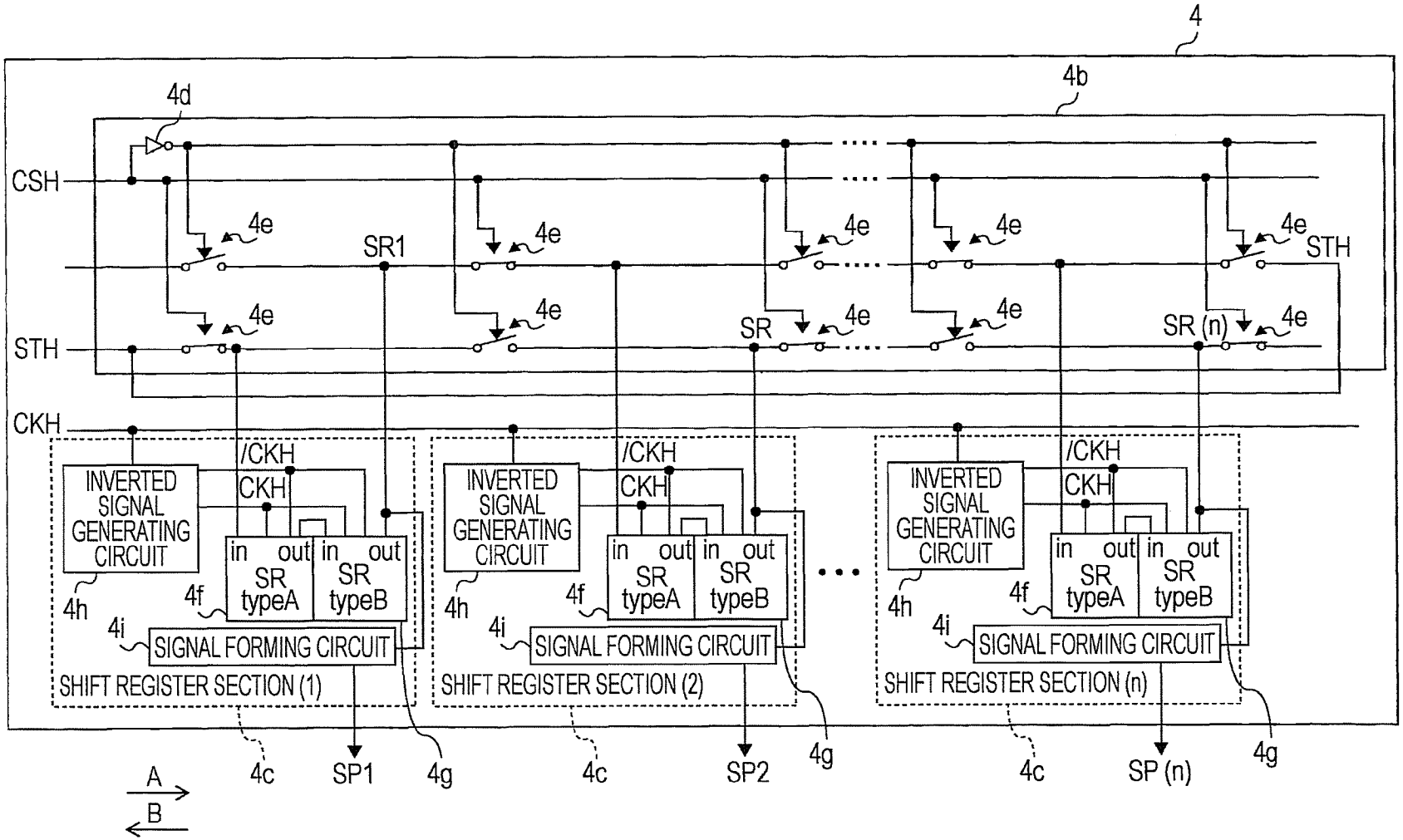
FIG. 2 is a circuit diagram used for describing an H-driver of a liquid crystal display device according to a first embodiment of the invention.
Figure 3:
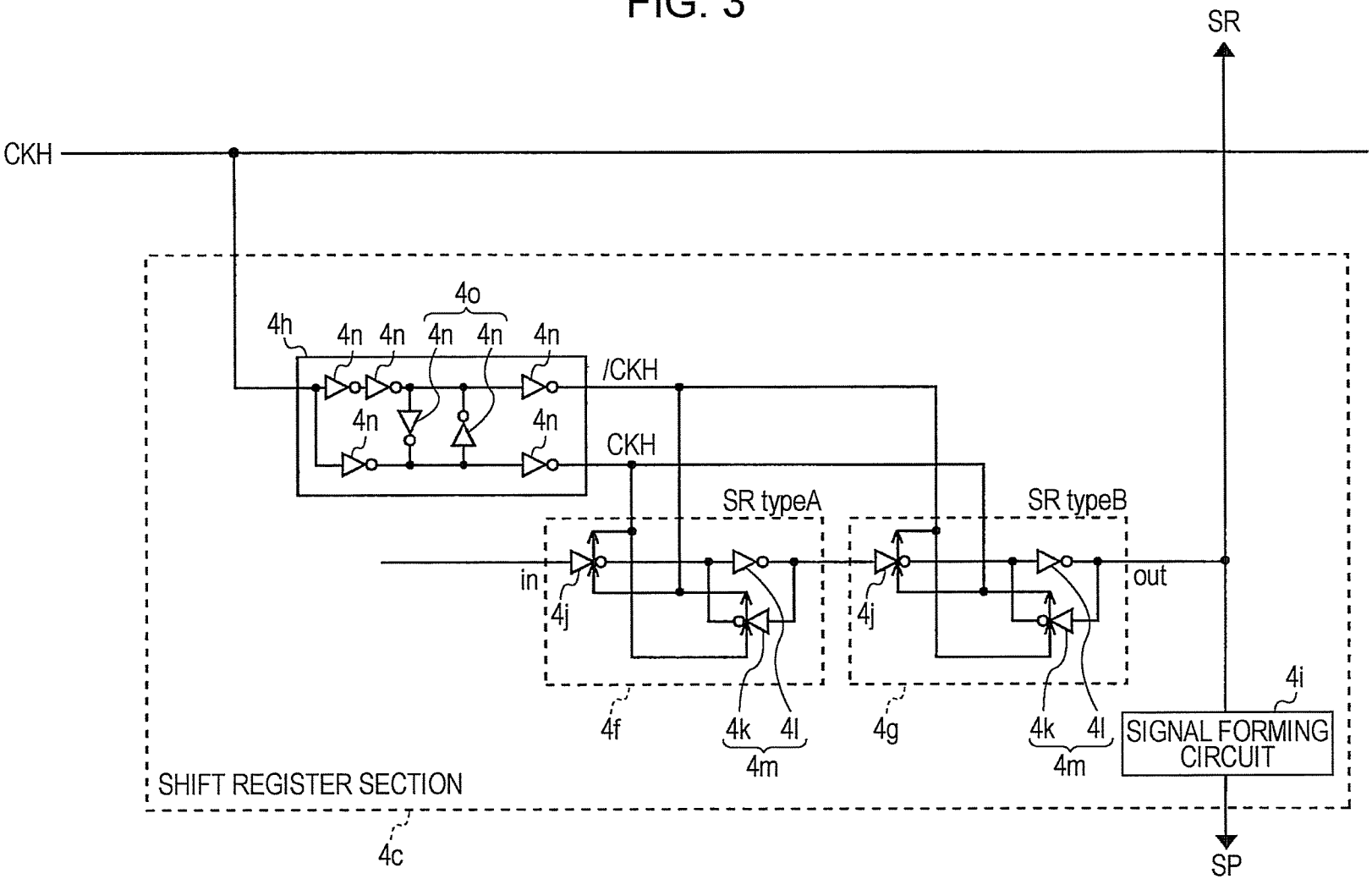
FIG. 3 is a circuit diagram used for describing an H-driver of a liquid crystal display device according to a first embodiment of the invention.
Figure 4:
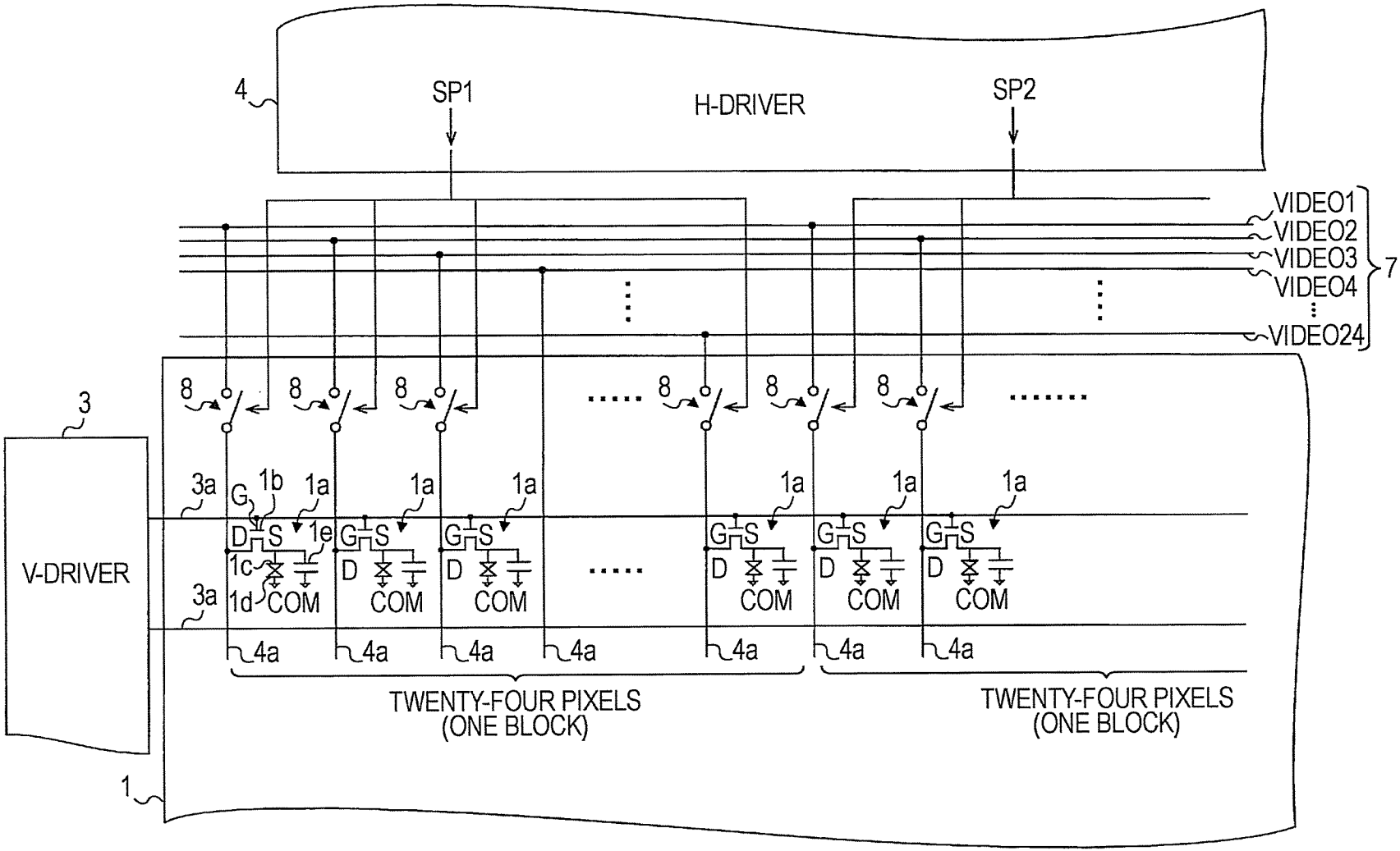
FIG. 4 is a circuit diagram used for describing a switch section of a liquid crystal display device according to a first embodiment of the invention.

FIG. 1 is a block diagram depicting an overall configuration of a liquid crystal display device according to a first embodiment of the invention. FIGS. 2 to 4 are diagrams, each being used for describing a detailed configuration of the liquid crystal display device according to the first embodiment of the invention. Firstly, a configuration of a liquid crystal display device 100 according to the first embodiment of the invention will be described with reference to FIGS. 1 to 4. In addition, in the first embodiment of the invention, the liquid crystal display device will be described as an example of the display devices to which the invention is applied.

As shown in FIG. 1, the liquid crystal display device 100 includes a display screen section 1, a driving IC 2, a V-driver 3, an H-driver 4, a backlight 5, and a COM-driver 6. In the display screen section 1, a plurality of pixels 1*a* are arranged in a matrix. In addition, in FIG. 1, only three pixels 1*a* are shown for the sake of simplification of the figure.

The driving IC 2 has a function of driving the whole of the liquid crystal display device 100. A plurality of gate lines 3*a* and a plurality of data lines 4*a* are connected to the V-driver 3 and the H-driver 4, respectively. Further, the plurality of gate lines 3*a* and the plurality of data lines 4*a* are arranged so as to be orthogonal to one another. The V-driver 3 has a function of a driving circuit for the gate lines 3*a*. Further, the H-driver 4 has a function of sequentially supplying pixel electrodes 1*c* described below with video signals via the data lines 4*a*. Moreover, the backlight 5 is configured to be a light source for transmission areas of the pixels 1*a*. The COM-driver 6 has a function of performing control of the voltage of common electrodes 1*d* described below.

Furthermore, each of the pixels 1*a* is composed of a pixel transistor 1*b* (TFT), a pixel electrode 1*c*, a common electrode 1*d* and a storage capacitor 1*e*. The pixel transistor 1*b* has a drain electrode D connected to one of the data lines 4*a*, and a source electrode S connected to the pixel electrode 1*c* and an electrode of the storage capacitor 1*e*. Moreover, the other electrode of the common electrode 1*d* and the other node of the storage capacitor 1*e* are connected to the COM-driver 6.

Moreover, as shown in FIG. 2, the H-driver 4 includes a scan direction controller 4*b* and a plurality of shift register sections 4*c* (n number of shift register sections in the first embodiment, wherein n=1, 2 . . . ). The scan direction controller 4*b* includes an inverter 4*d* and a plurality of switch sections 4*e*. Further, the scan direction controller 4*b* is configured to be capable of performing control of outputting the order of the sampling pulses (i.e., performing control of the direction of scanning) in accordance with a direct-current CSH signal supplied from the driving IC 2.

More specifically, for example, in the case where the CSH signal of an H-level is supplied to the scan direction controller 4*b*, the turned on/off conditions of respective switch sections 4*e* are as shown in FIG. 2. That is, an STH signal is supplied to a shift register section (1) shown in FIG. 2, which operates as a first stage of the shift register sections 4*c*, and an SR1 signal is outputted from the shift register section (1). Further, the SR1 signal is inputted to a second stage of the shift register sections 4*c* (i.e., a shift register section (2), shown in FIG. 2), and an SR2 signal is outputted from the shift register section (2). Further, the SR2 signal is supplied to a third stage of the shift register sections 4*c*. That is, in this case, a signal (i.e., SR1, SR2 . . . , or SRn) outputted from each stage of the shift register sections 4*c* is configured to be sequentially supplied to the next stage of the shift register sections 4*c*. Further, a sampling pulse (i.e., SP1, SP2 . . . , or SPn) is configured to be sequentially outputted from each of the shift register sections 4*c* supplied with one of the SR signals, in the order indicated by an arrow A shown in FIG. 2.

In contrast, in the case where the CSH signal of an L level is supplied to the scan direction controller 4*b*, the turned on/off conditions of respective switch sections 4*e* are conditions resulting from inversion of those shown in FIG. 2. That is, an STH signal is supplied to a shift register section (n) shown in FIG. 2, which operates as a first stage of the shift register sections 4*c*, and an SRn signal is outputted from the shift register section (n). Further, the SRn−1 signal is outputted from a second stage shift of the register sections 4*c* (i.e., a shift register section (n−1)), which is not shown in FIG. 2, and further, the SRn−1 signal is supplied to a third stage of the shift register sections 4*c*. Thus, in the same manner as or in a manner similar to that described above, in this case, the scan direction controller 4*b* is configured to sequentially output a sampling pulse (i.e., SPn . . . SP2, or SP1) from each of the shift register sections 4*c* to which one of the SR signals is supplied, in the order indicated by an arrow B shown in FIG. 2.

Here, in the first embodiment of the invention, as shown in FIG. 2, each of the shift register sections 4*c* includes two shift registers 4*f* and 4*g*, an inverted signal generating circuit 4*h*, and a signal forming circuit 4*i*. More specifically, as shown in FIG. 3, the shift register 4*f* is composed of an inverter 4*j* and a latch circuit 4*m* including inverters 4*k* and 4*l*. Either the STH signal outputted from the driving IC 2 or the SR signal outputted from the previous stage of the shift register sections 4*c* is connected to an input terminal of the shift register 4*f* (i.e., an input terminal of the inverter 4*j*, which is denoted by "in" in FIG. 3). Further, an output terminal of the inverter 4*j* is connected to an input terminal of the latch circuit 4*m*. In addition, the inverters 4*j* and 4*k* are composed of clocked inverters, respective outputs of which are controlled by clock signals.

Further, in the first embodiment of the invention, the shift register 4*f* and the shift register 4*g* are configured to have the same circuitry, and an output terminal of the shift register 4*f* (i.e., an output terminal of the latch circuit 4*m*) is connected to an input terminal of the shift register 4*g* (i.e., an input terminal of the inverter 4*j*).

Further, the inverted signal generating circuit 4*h* is configured to generate two-phase clocks, which are inverted with respect to each other, from the clock signal supplied from the driving IC 2, and the generated two-phase clocks are configured to be inputted to the inverter 4*j*, which is a clocked inverter, in the shift register 4*f* and the inverter 4*k*, which is also a clocked inverter, in the shift register 4*g*, respectively.

Moreover, the inverted signal generating circuit 4*h* is composed of seven inverters 4*n*. Specifically, a latch circuit 4*o* is constituted by two inverters 4*n*. Further, an output terminal of two serially-connected inverters 4*n* is connected to one of input terminals of the latch circuit 4*o* and also an output terminal of an inverter 4*n* is connected to the other one of input terminals of the latch circuit 4*o*. Further, two output terminals of the latch circuit 4*o* are connected to input terminals of inverters 4*n*, respectively.

Moreover, an output terminal of the shift register 4*g* (which is denoted by "out" in FIG. 3) is connected to the signal forming circuit 4*i*. The signal forming circuit 4*i* is configured to output a sampling pulse (SP) obtained by forming an output signal from the shift register 4*g* to the switch sections 8 described below (refer to FIG. 4).

As described above, in the first embodiment of the invention, in each of the shift register sections 4*c*, one sampling pulse is configured to be generated by the two shift registers 4*f* and 4*g*. Further, a signal from the shift register 4*g* is configured to be outputted as a sampling pulse, as well as outputted to the next stage of the shift register sections 4*c* as an SR signal. In addition, the sampling pulse is a signal for performing control of turning on/off of the switch sections 8 described below (refer to FIG. 4).

Moreover, in the first embodiment of the invention, as shown in FIG. 4, each pixel block is composed of twenty-four pixels 1*a*. Specifically, video signal lines 7 composed of twenty-four signal lines are wired in the edge portion of the display screen section 1, and each of the video signal lines 7 and one of the data lines 4*a* corresponding to one of the twenty-four pixels 1*a* in one pixel block are interconnected via one of the switch sections 8 (HSW). Further, twenty-four switches of the switch sections 8, which correspond to the twenty-four pixels in one of the pixel blocks, respectively, are configured to be on/off controlled by one sampling pulse. That is, one sampling pulse is configured to allow the twenty-four switches of the switch sections 8 to simultaneously turn on, so that the video signals are supplied from the twenty-four video signal lines 7 to the twenty-four pixel electrodes 1*c* through the corresponding twenty-four switches of the switch sections 8, respectively. Accordingly, as described above, the liquid crystal display device 100 according to the first embodiment of the invention is configured to perform writing of the video signals by means of a sequential writing method on a block-by-block basis.

Figure 5:
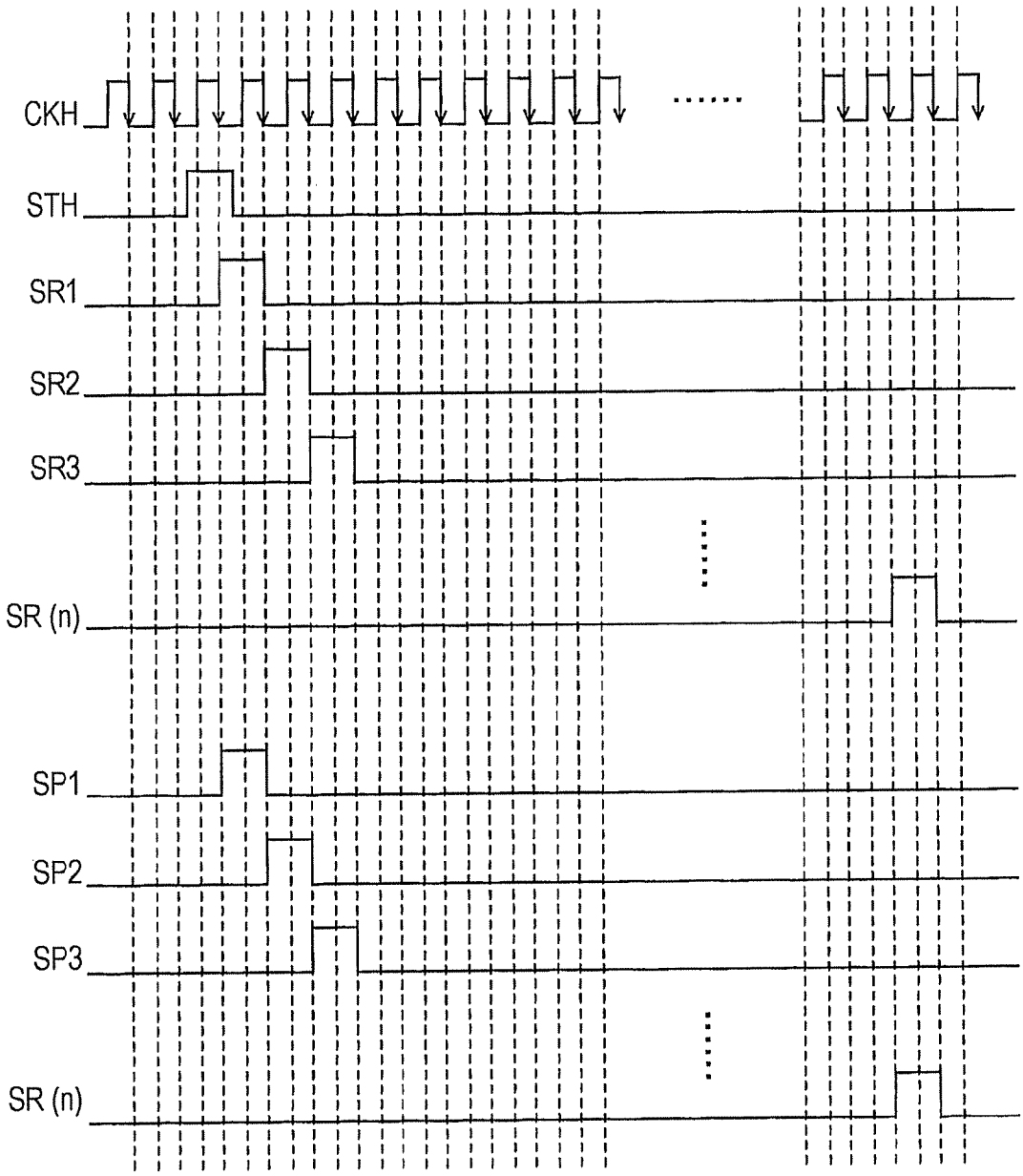
FIG. 5 is a timing chart used for describing operations with respect to writing into pixel electrodes, in a liquid crystal display device according to a first embodiment of the invention.
Figure 6:
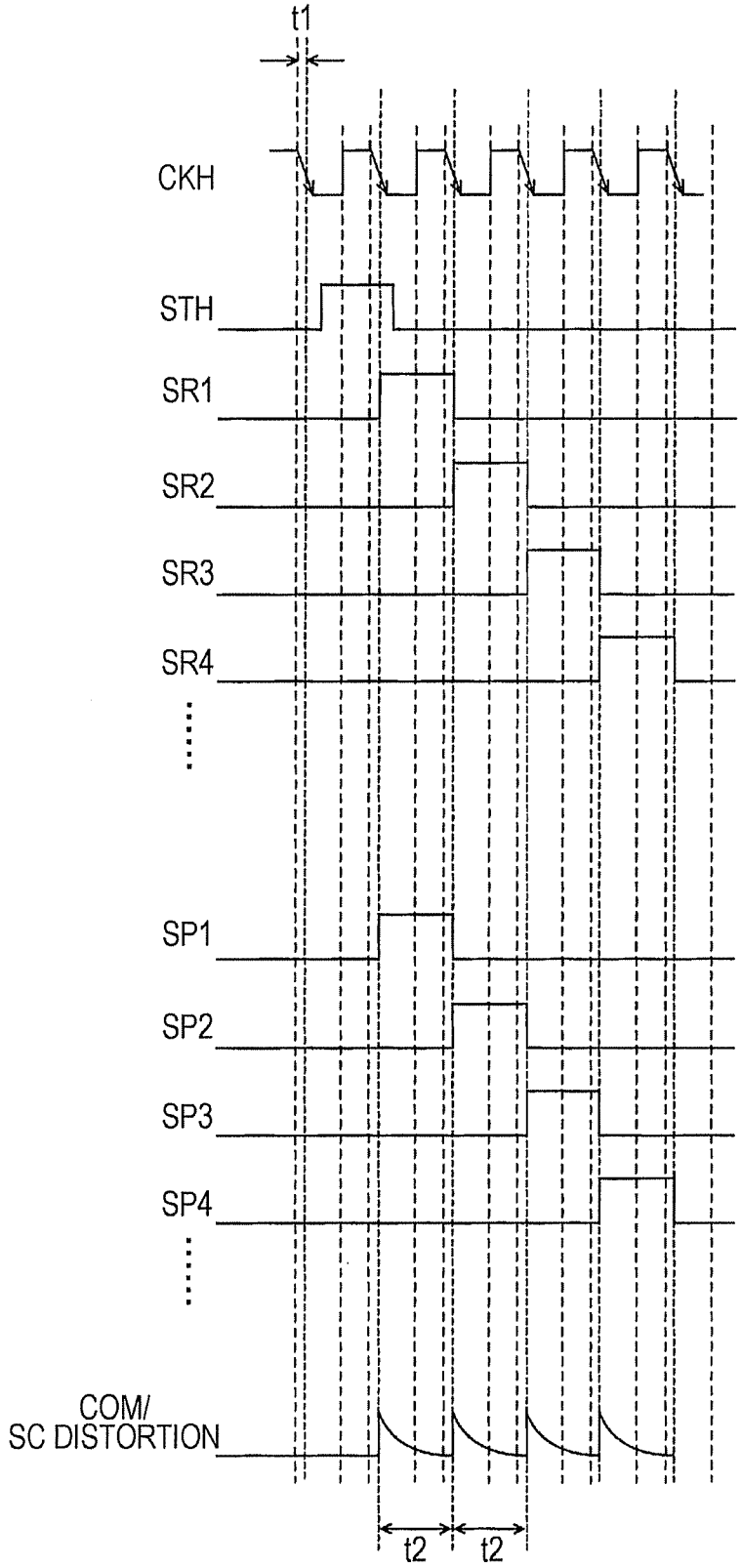
FIG. 6 is a timing chart used for describing operations with respect to writing into pixel electrodes, in a liquid crystal display device according to a first embodiment of the invention.
Figure 7:
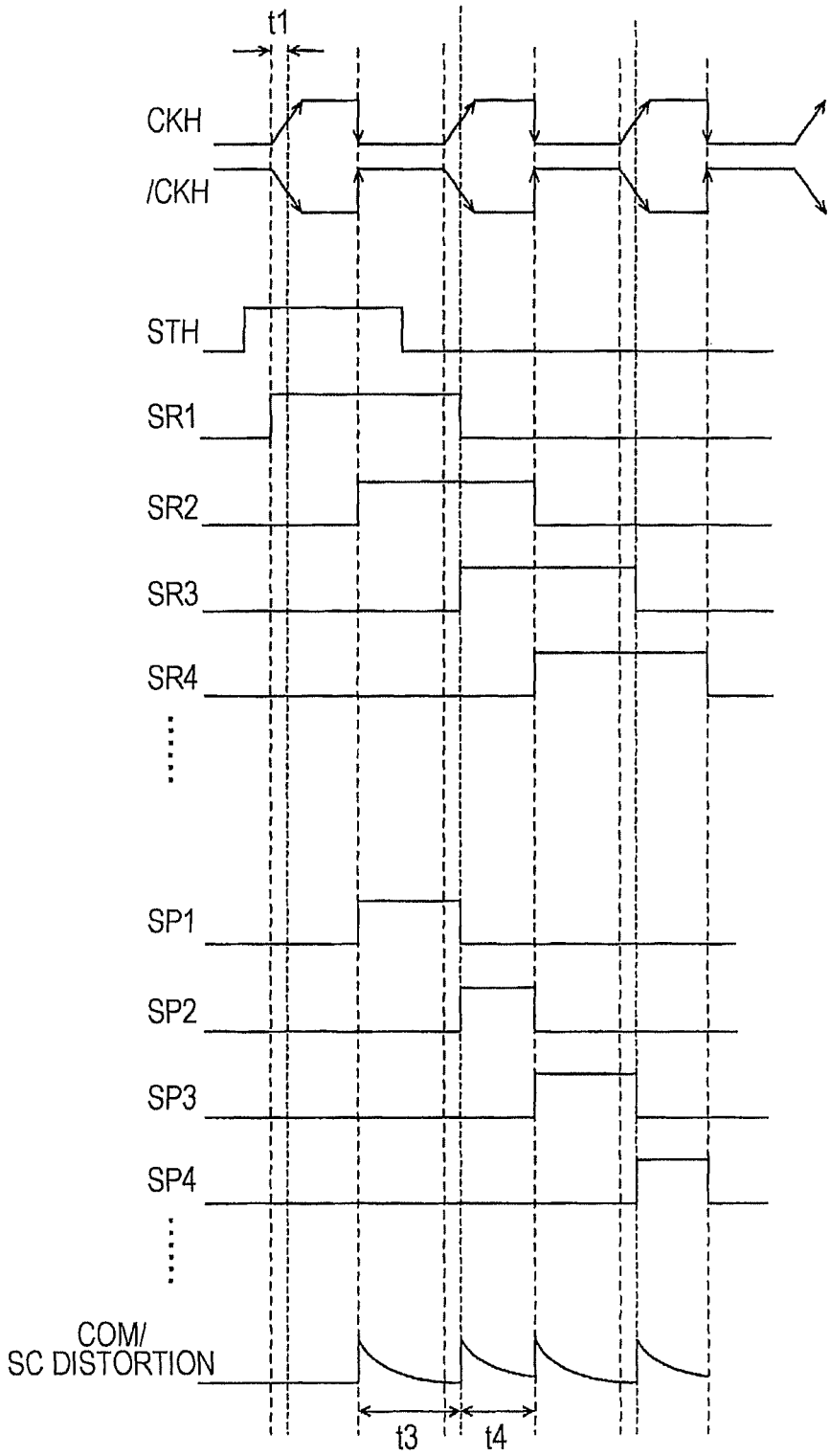
FIG. 7 is a timing chart used for describing a comparative example with respect to a liquid crystal display device according to a first embodiment of the invention.

FIGS. 5 and 6 are diagrams used for describing operations of the liquid crystal display device according to the first embodiment of the invention. FIG. 7 is a diagram used for describing a comparative example with the liquid crystal display device according to the first embodiment of the invention. Hereinafter, operations of the liquid crystal display device 100 according to the first embodiment of the invention will be described with reference to FIG. 2 and FIGS. 4 to 7.

Firstly, as shown in FIG. 5, the STH signal (refer to FIG. 2) originated from the driving IC 2 is supplied to the first stage of the shift register sections 4*c* (i.e., a shift register section (1)) via the scan direction controller 4*b*. Further, The SR1 signal and the SP1 signal (i.e., the sampling pulse) are outputted from the first stage of the shift register sections 4*c* in synchronization with the first falling edge of a pulse of the clock signal under the condition where the STH signal is supplied. At this time, the SR1 signal is inputted to the next stage of the shift register sections 4*c* (i.e., a shift register section (2) shown in FIG. 2), and further, the SP1 signal is outputted as a turning-on signal to the twenty-four switches of the switch section 8 which correspond to one of the pixel blocks (refer to FIG. 4), so that the twenty-four switches of the switch section 8 corresponding to the SP1 signal are simultaneously under the turned-on condition where the writing of the video signals is performed.

It should be noted, here, that, in the first embodiment of the invention, by generating one sampling pulse from the two serially-connected shift registers, no SR signal and sampling pulse are outputted in synchronization with the rising edge of a next pulse of the clock signal, and further, in synchronization with the falling edge of the next pulse of the clock signal, the SR1 signal and the SP1 signal are not under the turned-off condition, and at the same time, the SR2 signal and the SP2 signal are outputted from the next stage of the shift register sections 4*c*, so that the twenty-four switches of the switch section 8 corresponding to the SP2 signal are simultaneously under the turned-on condition where the writing of the video signals is performed. In the same manner as or in a manner similar to that described above, in synchronization with the falling edge of a further next pulse of the clock signal, the SR2 signal and the SP2 signal are not under the turned-off condition, and at the same time, the SR3 signal and the SP3 signal are outputted from a further next stage of the shift register sections 4*c* (i.e., a shift register section (3), not shown in FIG.

2). Moreover, the operations described above are sequentially performed in association with the following stages of the shift register sections 4*c* including the final stage of the shift register sections 4*c* (i.e., a shift register section (n) shown in FIG. 2), and thereby, the writing of the video signals into all of the pixels 1*a* arranged in one row is performed.

As described above, in the first embodiment of the invention, the writings of the video signals into all of pixels 1*a* are performed on the basis of only the falling edges of the clock signal.

Hereinafter, operations of the liquid crystal display device 100 according to the first embodiment of the invention in the case where each of the rising edge and the falling edge of the clock signal has a delay of a period of time longer than under a normal condition will be described In addition, in the first embodiment of the invention, more specifically, operations in the case where only the falling edge of the clock signal has a delay of a period of time t1 longer than under a normal condition will be described with reference to FIG. 6.

Firstly, once the STH signal is supplied, the SR1 signal and the SP1 signal are outputted in synchronization with the falling edge of a pulse of the clock signal. In this case, the SR1 signal and the SP1 signal are outputted with a delay of substantially the same period of time as the delay of the period of time t1 of the clock signal. Further, in synchronization with the falling edge of a next pulse of the clock signal, the SR1 signal and the SP1 signal are under the turned-off condition, and the SP2 signal and the SP2 signal are outputted. In this case, the falling edges of the SR1 signal and the SP1 signal and the rising edges of the SR2 signal and the SP2 signal have a delay of substantially the same period of time as the delay of the period of time t1 of the clock signal. Furthermore, this operation is sequentially performed in association with the following stages of the shift register sections 4*c* including the final stage of the shift register sections 4*c*. As a result, each of the rising edge and the falling edge of each sampling pulse (i.e., the SP signal) has a delay of substantially the same period of time t1, so that each sampling pulse has substantially the same pulse width t2. Therefore, it follows that the ratio of the returned level of the common voltage 1*d*, which varies due to parasitic capacitance, to the original level of the common voltage 1*d* is substantially the same for every pixel.

In contrast, as a comparative example, operations in the existing method for generating sampling pulses by using shift registers will be hereinafter described with reference to FIG. 7. In the comparative example of the existing method, the shift register is configured to output one sampling pulse obtained by shifting the output signal (i.e., the SR signal) by a half of a clock period of the clock signal, and one shift register is configured to generate one sampling pulse. In this configuration, the sampling pulses outputted from even-numbered stages of the shift registers are not under the turned-on condition in synchronization with the rising edges of the CKH signal, and are under the turned-off condition in synchronization with the falling edges of the CKH signal. On the contrary, the sampling pulses outputted from odd-numbered stages of the shift registers are under the turned-on condition in synchronization with the rising edges of the /CKH signal, and are under the turned-off condition in synchronization with the falling edges of the /CKH signal. Additionally, in the comparative example, the rising time of the CKH signal and the falling time of the /CKH signal are periods of time t1 longer than those under a normal condition.

Firstly, under the condition where the STH signal is supplied, the SR1 signal is generated with a delay of a period of time t1 in synchronization with the rising edge of a pulse of the CKH signal. Under this condition, in synchronization with the falling edge of the pulse of the CKH signal, the SR2 signal is outputted, and at the same time, the SP1 signal is outputted. That is, the SP1 signal is outputted in synchronization with the rising edge of a pulse of the /CKH signal. Further, in synchronization with the rising edge of a next pulse of the CKH signal, the SR1 signal is under the turned-off condition with a delay of the period of time t1, and at the same time, the SP1 signal is also under the turned-off condition. That is, the SP1 signal is under the turned-off condition in synchronization with the falling edge of the pulse of the /CKH signal. In addition, during this time, the SP1 signal has been under the turned-on condition for a period of time t3. Further, at this time, the SR3 signal is outputted with a delay of the period of time t1, as well as the SP2 signal is outputted with a delay of the period of time t1. Further, in synchronization with the falling edge of the next pulse of the CKH signal, the SR2 signal is under the turned-off condition, as well as the SP2 signal being under the turned-off condition. Additionally, during this time, the SP2 signal has been under the turned-on condition for a period of a time t4 that is shorter than the period of time t3.

Accordingly, as described above, in the existing method using the shift registers, in the case where the rising time and the falling time of the clock signal are longer than those under a normal condition, the pulse width (t3) of the sampling pulses supplied from odd-numbered stages of the shift registers is different from the pulse width (t4) of the sampling pulses supplied from even-numbered stages of the shift registers. That is, between the period of time t3 during which the writing of the video signals is performed on the basis of the sampling pulses supplied from the odd-numbered stages of the shift registers and the period of time t4 during which the writing of the video signals is performed on the basis of the sampling pulses supplied from the even-numbered stages of the shift registers, the period of time t3 is double the period of time t1 longer than the period of time t4, and therefore, obviously, it causes a difference of double the period of time t1 in the period of time during which the writing of the video signals is performed. Moreover, in the case where the voltage level of the common electrode 1*d* varies due to the parasitic capacitance generated between the data lines 4*a* and the wiring of the common electrode 1*d*, it is obvious that, in comparison with the ratio of the returned voltage level of the common electrodes 1*d* to the original voltage level of the common electrode 1*d* in the pixels 1*a* supplied with the sampling pulses each having the pulse width t3, the ratio of the returned voltage level of the common electrodes 1*d* to the original voltage level of the common electrode 1*d* in the pixels 1*a* supplied with the sampling pulses each having the pulse width t4 is lower.

Figure 8:
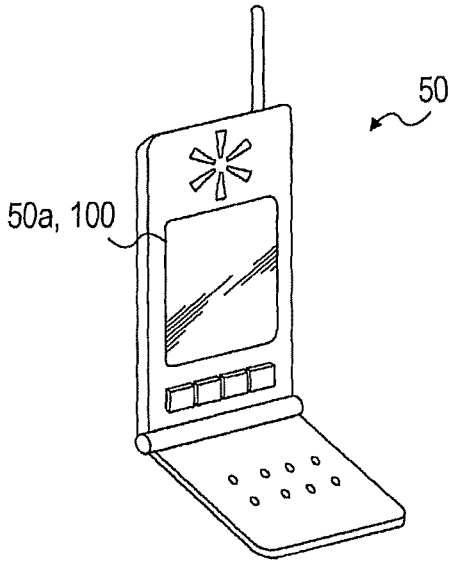
FIG. 8 is a diagram used for describing an electronic device including a liquid crystal display device according to a first embodiment of the invention.
Figure 9:
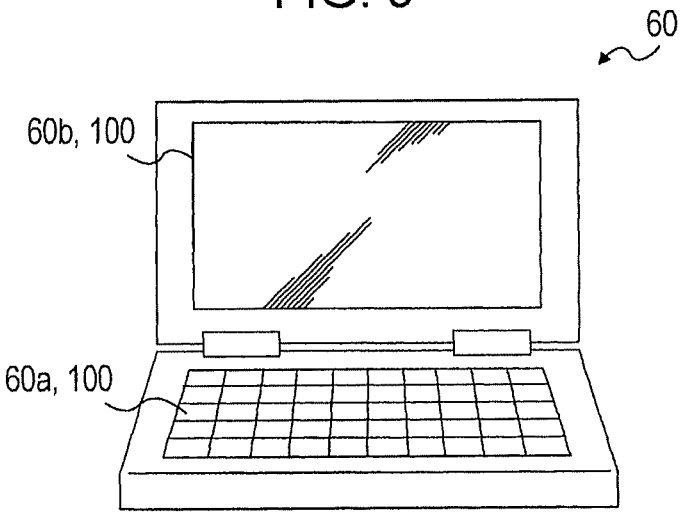
FIG. 9 is a diagram used for describing an electronic device including a liquid crystal display device according to a first embodiment of the invention.

FIGS. 8 and 9 are diagrams used for describing one example and another example, respectively, in each of which an electronic device uses the liquid crystal display device according to the first embodiment of the invention. Hereinafter, electronic devices using the liquid crystal display device 100 according to the first embodiment of the invention will be described with reference to FIGS. 8 and 9.

As shown in FIGS. 8 and 9, it is possible to use the liquid crystal display device 100 according to the first embodiment of the invention in electronic devices, such as a mobile phone 50 and a personal computer (PC) 60. In the mobile phone 50 shown in FIG. 8, the liquid crystal display device 100 according to the first embodiment of the invention is used in a display screen 50*a*. Moreover, in the PC 60 shown in FIG. 9, the liquid crystal display device 100 according to the first embodiment of the invention can be used in data inputting sections such as a keyboard 60*a*, and also in a display screen 60*b* and so on. Moreover, by incorporating peripheral circuits on substrates inside a liquid crystal display panel of an electronic device, it is possible to considerably reduce the number of parts, as well as to lighten and downsize the whole of the electronic device.

In the first embodiment of the invention, as described above, even when the rising time (tr) and the falling time (tf) of the clock signal are mutually different, since all of the sampling pulses are configured to be generated on the basis of only the timing of falling edges of the clock signal (CKH), it results in a delay of substantially the same period of time occurring in each of the rising edge and the falling edge of the generated sampling pulses. For this reason, it is possible to generate the sampling pulses each having substantially the same pulse width, and thus, it is possible to perform writing of the video signals into each of the pixels 1*a* during substantially the same period of time t2. Further, in this case, even when the voltage level of the common electrode 1*d* varies due to the parasitic capacitance occurring between the data lines 4*a* and the wiring of the common electrodes 1*d*, the ratio of the returned voltage level of the common electrode 1*d* to the original voltage level of the common electrode 1*d* in each of the pixels 1*a* becomes equal owing to substantially the same pulse width of each sampling pulse. Accordingly, it is possible to prevent a difference of brightness for each of the pixels 1*a*, and thus, to prevent the quality of image display from being diminished.

Moreover, in the above-described first embodiment of the invention, by providing a configuration in which one sampling pulse is generated on the basis of the two shift registers 4*f* and 4*g*, it is possible to generate a sampling pulse on the basis of only the falling edge of the clock signal in each of the shift register sections 4*c*. That is, as described above in the comparative example, in the case where one sampling pulse is generated by one shift register, sampling pulses generated on the basis of the rising edges of the clock signal are outputted from odd-numbered stages of the shift registers, whereas sampling pulses generated on the basis of the falling edges of the clock signal are outputted from even-numbered stages of the shift registers. On the contrary, in the first embodiment of the invention, it is possible to surely generate sampling pulses on the basis of only the falling edges of the clock signal.

Moreover, in the above-described first embodiment of the invention, by providing a configuration in which twenty-four pixels 1*a* constitute one pixel block, and the writing of the video signals into each of the pixels 1*a* in one of the pixel blocks is simultaneously performed on the basis of one sampling pulse generated from one of the shift register sections 4*c*, it is possible to simultaneously perform writing of the video signals into one of the pixel blocks, which is constituted by twenty-four pixels, on the basis of one sampling pulse. Further, in this case, each sampling pulse supplied to one of the pixel blocks is generated on the basis of only the falling edge of the pulse, and thus, has substantially the same pulse width, so that it is possible to prevent the difference of brightness among the pixel blocks.

Moreover, in the above-described first embodiment of the invention, by allowing the switch sections 8 which correspond to the pixels 1*a* in a certain pixel block, respectively, to simultaneously turn on, on the basis of one sampling pulse supplied from one of the shift register sections 4*c*, the video signal is supplied to each of the pixels 1*a* in the pixel block. By providing such a configuration as described above, one of the sampling pulses each having substantially the same pulse width is sequentially supplied to the switch sections 8 in each of the pixel blocks, so that each of the switch sections 8 in each of the pixel blocks is controlled so as to turn on during substantially the same period of time, and thus, it is possible to surely perform writing of the video signal into each of the pixels 1*a* in each of the pixel blocks during substantially the same period of time.

Moreover, in the above-described first embodiment of the invention, by providing a configuration in which the two shift registers 4*f* and 4*g* in each of the shift register sections 4*c* are supplied with the clock signal, and the sampling pulse is outputted from only the shift register 4*g*, firstly, in the case where a signal is inputted to the shift register 4*f* on the basis of the falling edge of a pulse of the clock signal, the sampling pulse is not outputted on the basis of the rising edge of the next pulse of the clock signal but is outputted on the basis of the falling edge of the next pulse of the clock signal from the shift register 4*g*, and therefore, it is possible to generate the sampling pulse on the basis of only the falling edge of the clock signal. Secondly, even in the case where a signal is inputted to the shift register 4*f* on the basis of the rising edge of the clock signal, it is possible to easily generate the sampling pulse on the basis of only the rising edge of the clock signal.

Moreover, in the above-described first embodiment of the invention, a signal outputted from the shift register 4*f* in each of the shift register sections 4*c* is inputted to the shift register 4*g* in the same shift register section 4*c*, and one sampling pulse is outputted from the shift register 4*g*. By providing such a configuration as described above, in the case where a signal is inputted to the shift register 4*f* on the basis of the falling edge of a pulse of the clock signal, on the basis of the rising edge of the next pulse of the clock signal, an output signal from the shift register 4*f* is not outputted as a sampling pulse but is supplied to the shift register 4*g*, and further, an output signal is outputted as a sampling pulse from the shift register 4*g* on the basis of the falling edge of the next pulse of the clock signal. Accordingly, it is possible to surely generate the sampling pulse on the basis of only the falling edge of the clock signal. Further, even in the case where a signal is inputted to the shift register 4*f* on the basis of the rising edge of the clock signal, it is possible to easily generate the sampling pulse on the basis of only the rising edge of the clock signal.

Moreover, in the above-described first embodiment of the invention, by providing a configuration in which an output signal generated from the shift register 4*g* in each of the shift register sections 4*c* is outputted to the corresponding switch sections 8 as a sampling pulse, and is inputted to the shift register 4*c* in a next stage of the shift register sections 4*c*, the outputting of a sampling pulse and the inputting of a signal to the next stage of the shift register sections 4*c* are simultaneously performed. That is, it possible to perform outputting of the sampling pulse and rising of an output signal in the next stage of the shift register sections 4*c* on the basis of the falling edges of the clock signal. Further, in the same manner as or in a manner similar to that described above, it possible to perform outputting of the sampling pulse and rising of the output signal in the next stage of the shift register sections 4*c* on the basis of the rising edges of the clock signal.

Second Embodiment

Figure 10:
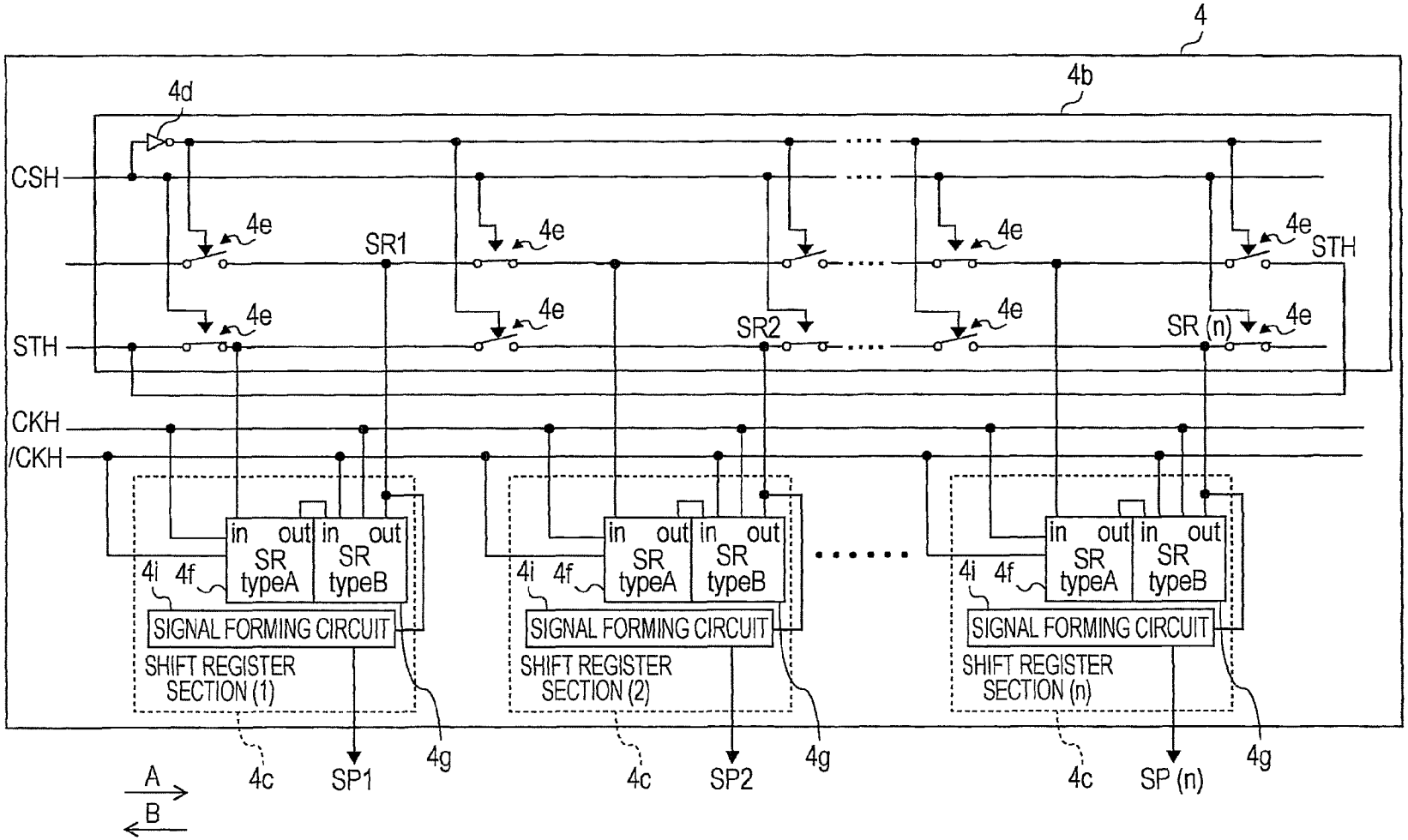
FIG. 10 is a block diagram depicting an overall configuration of a liquid crystal display device according to a second embodiment of the invention.
Figure 11:
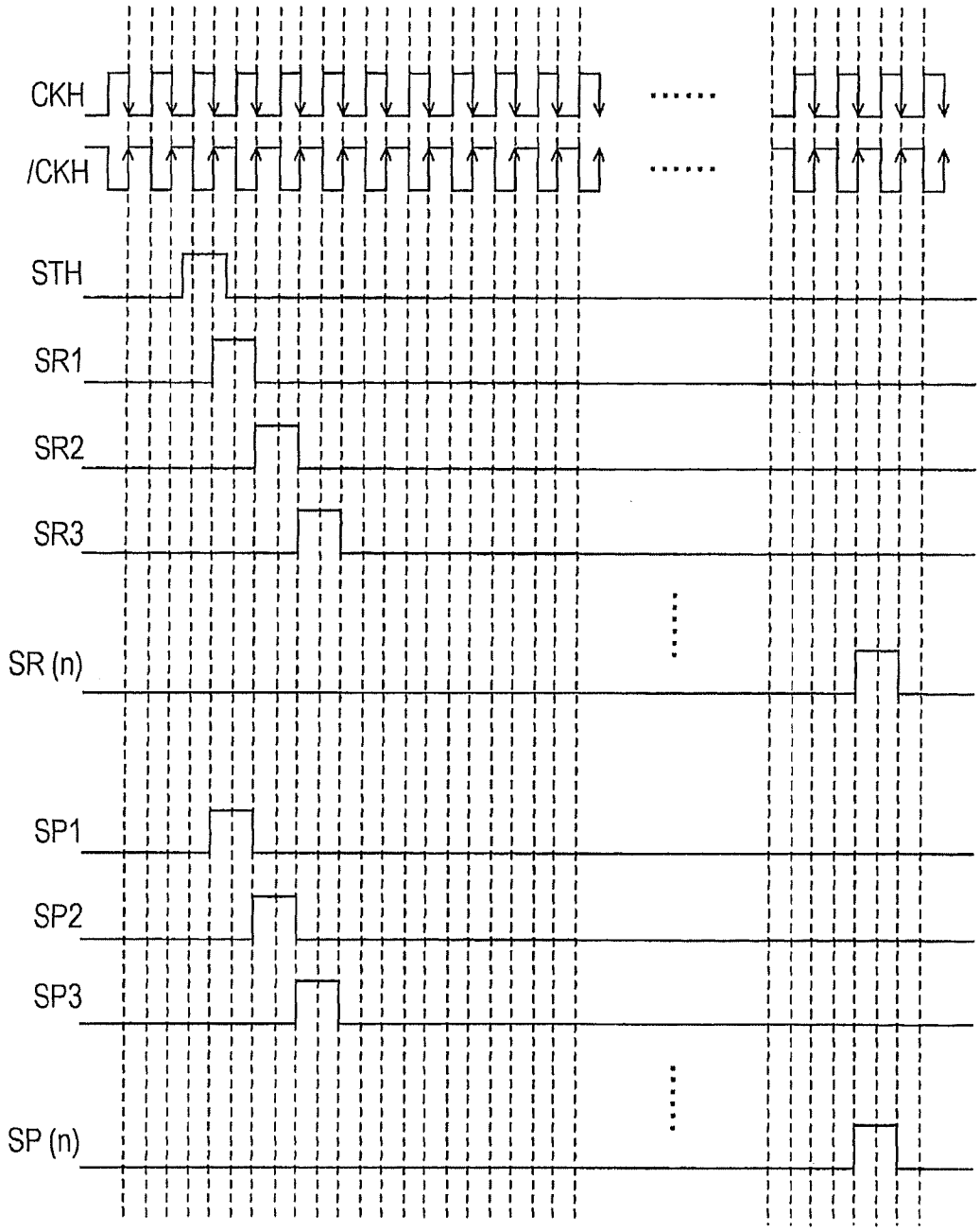
FIG. 11 is a timing chart used for describing operations with respect to writing into pixel electrodes, in a liquid crystal display device according to a second embodiment of the invention.

FIGS. 10 and 11 are diagrams each depicting a configuration of a liquid crystal display device according to a second embodiment of the invention. In the second embodiment of the invention, differing from the first embodiment in which each of the shift register sections 4*c* is configured to be supplied with an one-phase clock signal, a liquid crystal display device 200 in which each of the shift register sections 4*c* is configured to be supplied with two-phase clock signals having mutually inverted phases will be described.

As shown in FIG. 10, the liquid crystal display device 200 according to the second embodiment of the invention is configured to supply two clock signals having mutually inverted phases (i.e., a CKH signal and a /CKH signal) to the shift register 4*f* and the shift register 4*g* in each of the shift register sections 4*c*. In addition, configurations other than this configuration in the second embodiment are the same as those in the first embodiment of the invention.

Moreover, as shown in FIG. 11, in the case where sampling pulses are generated on the basis of the two-phase clock signals, in the same manner as or in a manner similar to that in the first embodiment of the invention, the sampling pulses (SP1 to SP(n)) are generated on the basis of only the falling edges of the CKH signal (i.e., the rising edges of the /CKH signal).

In the second embodiment of the invention, as described above, even in the case where the two-phase clock signals are supplied to each of the shift register sections 4*c*, all sampling pulses can be generated on the basis of only the falling edges of the clock signal. Further, differing from the first embodiment in which two-phase clock signals are generated from the one-phase clock signal by the inverted signal generating circuit 4*h*, it is not necessary to provide the inverted signal generating circuit 4*h*, and therefore, it is possible to prevent the configuration of the circuit from being complicated by just that much.

Third Embodiment

Figure 12:
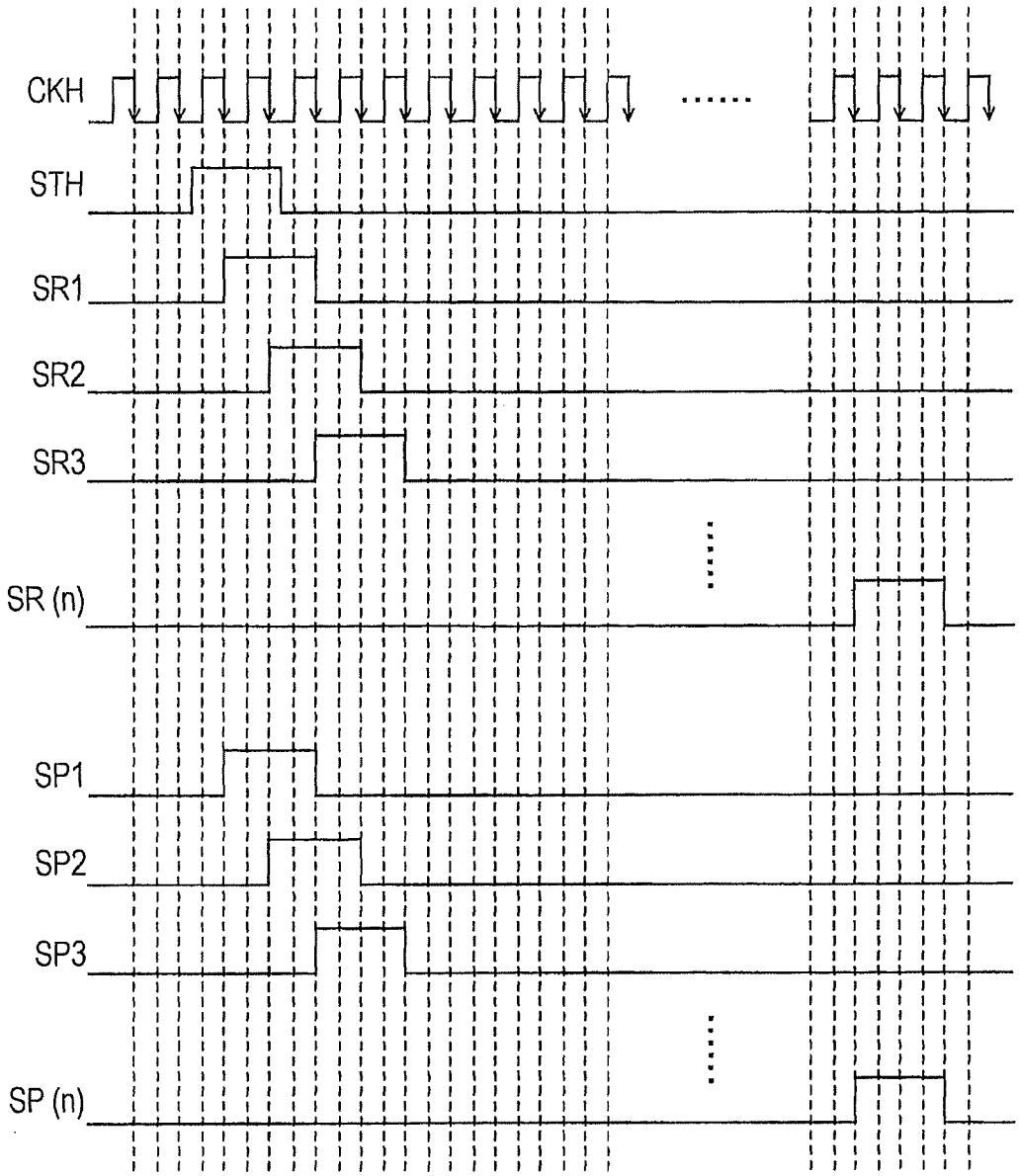
FIG. 12 is a timing chart used for describing operations with respect to writing into pixel electrodes, in a liquid crystal display device according to a third embodiment of the invention.

FIG. 12 is a timing chart depicting operations in the third embodiment of the invention. In the third embodiment of the invention, operations in the case where the pulse width of the STH signal (i.e., the start signal) is wider than that in the above-described first embodiment will be described with reference to FIG. 12. Additionally, the configuration of the liquid crystal display device 300 according to the third embodiment of the invention is the same as that of the liquid crystal display device 100 according to the first embodiment of the invention.

In the third embodiment of the invention, the pulse width of the start signal, which is configured to be substantially equal to one clock period of the clock signal in the operations associated with the first embodiment of the invention shown in FIG. 5 (i.e., operations in a non-overlapping method in which, subsequent to completion of the writing of the video signals into a certain pixel block, the writing into a next pixel block is performed), is configured to be made wider to the extent substantially equal to two clock periods of the clock signal. By providing such a configuration as described above, the method of writing of the video signals into the pixel blocks in the liquid crystal display device 300 according to the third embodiment of the invention is changed from the non-overlapping method employed in the first embodiment to an overlapping method.

More specifically, in the liquid crystal display device 300 according to the third embodiment of the invention, by providing a configuration in which one sampling pulse is generated by the two shift registers, even in the case where the pulse width of the start signal is made wider, the sampling pulse outputted on the basis of the falling edge of a pulse of the clock signal is not under the turned-off condition on the falling edge of the next pulse of the clock signal, but is under the turned-off condition on the falling edge of the further next pulse of the clock signal. That is, each of the sampling pulses which has the pulse width generated on the basis of the pulse width of the start signal is outputted only once.

Figure 13:
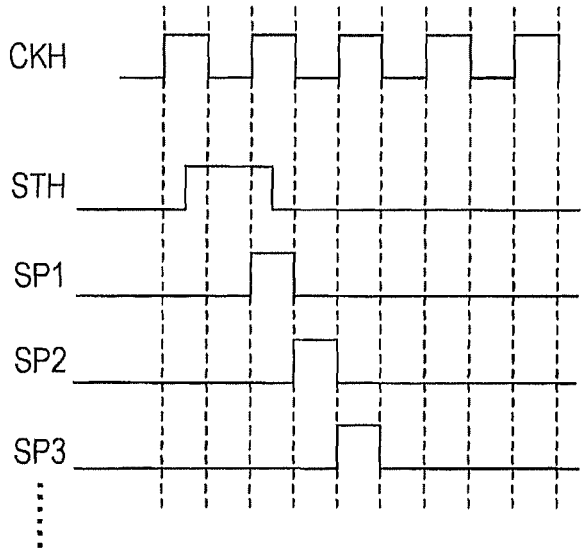
FIG. 13 is a timing chart used for describing a comparative example with respect to a liquid crystal display device according to a third embodiment of the invention.
Figure 14:
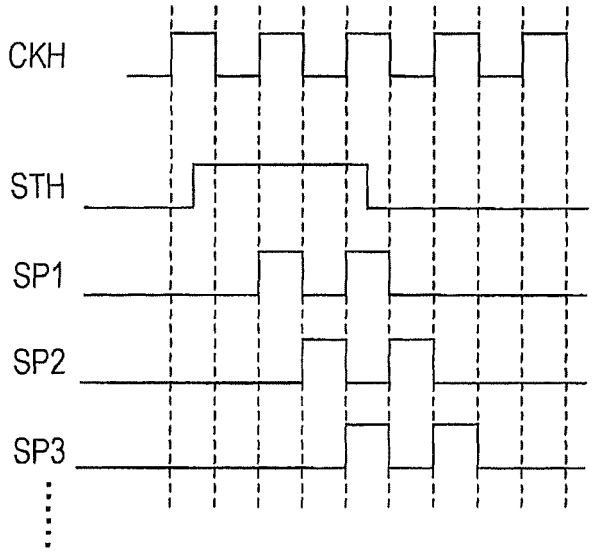
FIG. 14 is a timing chart used for describing a comparative example with respect to a liquid crystal display device according to a third embodiment of the invention.

On the contrary, in the configuration of the existing liquid crystal display device in which one sampling pulse is generated by one shift register, for example, resulting from the configuration of the writing method in accordance with the non-overlapping method, from which a time chart shown in FIG. 13 is derived, in the case where the pulse width of the starting pulse is made wider, as shown in FIG. 14, one sampling pulse is continuously generated twice by each shift register. This is due to a reason in which, because of a logical multiplication of the clock signal and the start pulse, in the case where the pulse width of the start signal is substantially equal to one clock period, the sampling pulse is under the turned-on condition in synchronization with the rising edge of the clock signal and is under the turned-off condition in synchronization with the falling edge of the clock signal. In this case, in the case where the pulse width of the start pulse is made wider to the extent of substantially two clock periods, a first sampling pulse is generated within a first period of the clock signal, and a second sampling pulse is generated within a second period of the clock signal. Therefore, in the configuration of the existing liquid crystal device, the mere changing of the pulse width of the start pulse does not lead to selection of either of the described-above two writing methods for writing the video signals into the pixels. In addition, in the case where an additional signal different from the clock signal is generated so that the timing of the sampling pulse can be varied by taking a logical multiplication of the generated signal and the start signal, it is possible to perform driving in accordance with the overlapping method. However, in this case, it is necessary to generate the additional signal.

In the third embodiment of the invention, by varying the pulse width of the start signal supplied in driving the shift registers, it is possible to perform writing of the video signals into pixels by using either the writing method in accordance with the non-overlapping method or the writing method in accordance with the overlapping method. For this reason, without changing the circuit configuration and merely by varying the pulse width of the start signal, it is possible to perform writing of the video signals into the pixels by using one of the two writing methods described above.

In addition, it should be appreciated that the embodiments disclosed above are only exemplification from all of the aspects of the invention and are not limited to. The scope of the invention is represented not by the foregoing description of the embodiments but by the following claims, and furthermore, includes all modifications and alterations within the scope and the meanings equal to those in accordance with the following claims.

For example, in the above-described first to third embodiments of the invention, the examples in which the invention is applied to the sequential writing method on a block-by-block basis, in which the writing of the video signals is performed by each block composed of a plurality of pixels, were described; however, the invention is not limited to the embodiments but is applicable to the sequential writing method on a point-by-point basis, in which the writing of the video signals is performed by each pixel.

Further, in the above-described first to third embodiment, the examples in which the invention is applied to a clock signal having a duty ratio of nearly 50% were described; however, the invention is not limited to the embodiments, but is applicable to cases where a clock signal having a duty ratio other than nearly 50% is employed.

The entire disclosure of Japanese Patent Application No. 2008-075300, filed Mar. 24, 2008 is expressly incorporated by reference herein.

What is claimed is:

1. A display device, comprising:

a plurality of shift register sections, each being configured to sequentially generate a sampling pulse on the basis of a clock signal for writing video signals into pixels;

a first pixel block including a first plurality of pixels;

a second pixel block including a second plurality of pixels;

video signal lines for supplying video signals for each of the first plurality of pixels and the second plurality of pixels;

a plurality of data lines each connecting a corresponding one of the video signal lines with a respective one of the first plurality of pixels and the second plurality of pixels; and switch sections provided for the data lines, and located between respective ones of the video signal lines and the data lines, wherein:

(a) each of the plurality of shift register sections includes an even number of shift registers, and include a signal forming circuit configured to output one sampling pulse based on a combined output of the plurality of shift registers;

(b) the one sampling pulse is generated by each of the plurality of shift register sections;

(c) substantially all of the sampling pulses are generated based on one of:

(i) selected rising edges of a clock signal; and (ii) selected falling edges of a clock signal (d) the first pixel block is supplied with a first sampling pulse generated from a first shift register section having an even number of shirt registers; and (e) the second pixel block is supplied with a second sampling pulse generated from a second shift register section having an even number of shift registers wherein a first plurality of video signals are simultaneously written into the first plurality of pixels in the first pixel block based on one sampling pulse generated by the first shift register section which includes an even number of shift registers, and wherein:

(a) one sampling pulse supplied to each of the pixel blocks is allowed to perform control of each of the switch sections which corresponds to one of the pixels in each of the pixel blocks; and (b) when a certain one of the pixel blocks is supplied with the video signals, the switch sections, each corresponding to one of the pixels in the certain one of the pixel blocks, are simultaneously turned on, so that respective video signals are supplied to the pixels in the certain one of the pixel blocks.

2. The display device of claim 1, wherein:

(a) each of the plurality of shift register sections includes two shift registers; and (b) for each of the plurality of shift register sections, one sampling pulse is generated based on the two shift registers.

3. The display device of claim 1, wherein:

(a) each of the plurality of shift register sections includes two shift registers;

(b) the clock signal is supplied to a first shift register and a second shift register of the two shift registers; and (c) the sampling pulse is outputted from the second shift register.

4. The display device of claim 3, wherein, in each of the shift register sections:

(a) a signal outputted from the first shift register of the two shift registers is inputted to the second shift register of the two shift registers; and (b) an output signal is generated as the sampling pulse by the second shift register.

5. The display device of claim 1, wherein, by varying the pulse width of a start pulse supplied when driving the shift registers, the writing of the video signals can be performed by either:

(a) a method in which, subsequent to completion of the writing of the video signals into a certain one of the pixel blocks, the writing of the video signals into a next one of the pixel blocks is performed; or (b) a method in which, under the condition where the writing of the video signals into the certain one of the pixel blocks is being performed, the writing of the video signals into the next one of the pixel blocks is performed.

6. The display device of claim 5, wherein:

(a) each of the plurality of shift register sections includes two shift registers;

(b) the clock signal is supplied to a first shift register and a second shift register of the two shift registers;

(c) the sampling pulse is outputted from the second shift register; and (d) an output signal generated by the second shift register in the shift register section is:

(i) outputted as the sampling pulse to the corresponding switch sections; and (ii) inputted to a first shift register in a next stage of the shift register sections.

7. An electronic device comprising:

a display device which includes:

(a) a plurality of shift register sections, each being configured to sequentially generate a sampling pulse on the basis of a clock signal for writing video signals into pixels;

(b) a first pixel block including a first plurality of pixels;

(c) a second pixel block including a second plurality of pixels;

(d) video signal lines for supplying video signals for each of the first plurality of pixels and the second plurality of pixels;

(e) a plurality of data lines each connecting a corresponding one of the video signal lines with a respective one of the first plurality of pixels and the second plurality of pixels; and (e) switch sections provided for the data lines, and located between respective ones of the video signal lines and the data lines, wherein:

each of the plurality of shift register sections includes an even number of shift registers and include a signal forming to output one sampling pulse based on a combined output of the plurality of shift registers;

(ii) the one sampling pulse is generated by each of the plurality of shift register sections;

(iii) substantially all of the sampling pulses are generated based on one of:

(A) selected rising edges of a clock signal; and (B) selected falling edges of a clock signal (iv) the first pixel block is supplied with a first sampling pulse generated from a first shift register section having an even number of shirt registers; and (v) the second pixel block is supplied with a second sampling pulse generated from a second shift register section having an even number of shift registers, wherein a first plurality of video signals are simultaneously written into the first plurality of pixels in the first pixel block based on one sampling pulse generated by the first shift register section which includes an even number of shift registers, and wherein:

(a) one sampling pulse supplied to each of the pixel blocks is allowed to perform control of each of the switch sections which corresponds to one of the pixels in each of the pixel blocks; and (b) when a certain one of the pixel blocks is supplied with the video signals, the switch sections, each corresponding to one of the pixels in the certain one of the pixel blocks, are simultaneously turned on, so that respective video signals are supplied to the pixels in the certain one of the pixel blocks.

8. The display device of claim 1, wherein;

(a) the first pixel block includes twenty-four pixels; and (b) the second pixel block includes twenty-four pixels.

* * * * *